US009033640B2

(12) United States Patent
Parker et al.

(10) Patent No.: US 9,033,640 B2
(45) Date of Patent: May 19, 2015

(54) ACTUATING SUPPORT RACK

(71) Applicant: The Heil Co., Chattanooga, TN (US)

(72) Inventors: Brian T. Parker, Signal Mountain, TN (US); David C. Gentry, Chattanooga, TN (US)

(73) Assignee: The Heil Co., Chattanooga, TN (US)

( * ) Notice: Subject to any disclaimer, the term of this patent is extended or adjusted under 35 U.S.C. 154(b) by 108 days.

(21) Appl. No.: 13/796,057

(22) Filed: Mar. 12, 2013

(65) Prior Publication Data

US 2014/0119861 A1 May 1, 2014

Related U.S. Application Data

(60) Provisional application No. 61/720,719, filed on Oct. 31, 2012.

(51) Int. Cl.

| | |
|---|---|
| ***B65F 3/02*** | (2006.01) |
| ***B65F 3/00*** | (2006.01) |
| ***B65F 3/04*** | (2006.01) |

(52) U.S. Cl.

CPC . *B65F 3/00* (2013.01); *B65F 3/041* (2013.01); *B65F 3/04* (2013.01); *B65F 2003/023* (2013.01)

(58) Field of Classification Search

USPC ..... 414/408, 409, 419, 421, 424, 555, 785, 414/913, 523; 248/274.1, 276.1, 282.1, 248/284.1, 292.1, 289.11, 291.1

See application file for complete search history.

(56) References Cited

U.S. PATENT DOCUMENTS

| | | | | |
|---|---|---|---|---|
| 3,006,492 | A | 10/1961 | Naughton | |
| 3,148,794 | A | 9/1964 | Sauer | |
| 4,239,441 | A | 12/1980 | Maynard | |
| 4,239,442 | A | 12/1980 | Maynard | |
| 4,313,707 | A * | 2/1982 | Bingman et al. | 414/409 |
| 4,461,607 | A * | 7/1984 | Smith | 414/406 |
| 4,978,243 | A | 12/1990 | Hensler | |
| 4,983,092 | A | 1/1991 | Richards | |
| 5,402,898 | A | 4/1995 | Lute | |
| 5,419,671 | A * | 5/1995 | Smith et al. | 414/421 |
| 5,609,261 | A | 3/1997 | Hensler | |
| 5,651,654 | A | 7/1997 | Christenson | |
| 5,720,589 | A * | 2/1998 | Christenson et al. | 414/408 |
| 5,755,547 | A | 5/1998 | Flerchinger et al. | |
| 5,769,592 | A * | 6/1998 | Christenson | 414/408 |
| 6,000,593 | A | 12/1999 | Chimenti | |
| 6,004,092 | A | 12/1999 | Johnson et al. | |
| 6,095,744 | A * | 8/2000 | Harrison | 414/408 |
| 6,644,906 | B2 * | 11/2003 | Bayne | 414/408 |
| 6,884,017 | B2 | 4/2005 | Arrez et al. | |
| 6,921,239 | B2 | 7/2005 | Arrez et al. | |
| 7,347,657 | B2 * | 3/2008 | Brunn | 414/408 |
| 7,390,159 | B2 * | 6/2008 | Rimsa et al. | 414/408 |

(Continued)

*Primary Examiner* — Kaitlin Joerger

(74) *Attorney, Agent, or Firm* — Harness, Dickey & Pierce, P.L.C.

(57) ABSTRACT

A support rack for a side loading arm of a refuse vehicle has a frame to secure with the refuse vehicle. A support member is pivotally coupled with the frame. The support member receives the side loading arm. An actuating mechanism is coupled between the frame and the support member. The actuating mechanism moves the support member between a first and a second position. In the first position, the support member is in a locked position which locks the side loading arm in position with the support rack during over road traveling conditions. In the second position, the support member is in an unlocked position to enable the side loading arm to move away from the support rack.

11 Claims, 5 Drawing Sheets

(56) References Cited

U.S. PATENT DOCUMENTS

| | | | | |
|---|---|---|---|---|
| 7,559,735 | B2 * | 7/2009 | Pruteanu et al. | 414/409 |
| 7,871,233 | B2 | 1/2011 | Arrez et al. | |
| 8,092,141 | B2 | 1/2012 | Curotto et al. | |
| 2003/0111501 | A1 | 6/2003 | McGraw et al. | |
| 2010/0183410 | A1 * | 7/2010 | Curotto | 414/408 |
| 2014/0056637 | A1 * | 2/2014 | Gentry et al. | 403/59 |
| 2014/0119860 | A1 * | 5/2014 | Stewart et al. | 414/408 |

* cited by examiner

ACTUATING SUPPORT RACK

CROSS-REFERENCE TO RELATED APPLICATION

This application claims the benefit of U.S. Provisional Application No. 61/720,719, filed on Oct. 31, 2012. The entire disclosure of the above application is incorporated herein by reference.

FIELD

The present disclosure relates to refuse vehicles and, more particularly, to a support rack to support a side loading arm during over road transportation.

BACKGROUND

Cradles or storage racks exist for carrying side loading arms of refuse vehicles during over road travel conditions. Ordinarily, the storage racks include an arm, via an interference fit, that connects the rack and arm together. However, over time, as the side loading arm is run multiple times and hits the rack during operation, the rack deforms. Once the rack is deformed, it no longer serves it purpose to support the arm during over road travel conditions. Thus, it is desirable in the art to have a support rack or cradle that is able to support the side loading arm during over road travel conditions for a long period of time.

The present disclosure provides the arm with such a cradle or storage rack design. The present disclosure provides an actuated rack that locks the side loading arm during over road traveling conditions. The rack is designed to have an over center actuating mechanism that locks the rack and side loading arm in position. The rack actuator moves the rack support between the lock and unlocked position.

SUMMARY

According to an aspect of the disclosure, a support rack for a side loading arm of a refuse vehicle comprises a frame to secure with the refuse vehicle. A support member is pivotally coupled with the frame. The support member receives the side loading arm. An actuating mechanism is coupled between the frame and the support member. The actuating mechanism moves the support member between a first and a second position. In the first position, the support member is in a locked position locking the side loading arm during over road traveling conditions. In the second position, the support member is in unlocked position enabling the side loading arm to be moved away from the rack. The actuating member further comprises a cylinder and a linkage to move the support member between the first and second positions. A pin is positioned on the support member to engage a bore on the side loading arm to lock the side loading arm in position. A biasing bracket is coupled with the frame to receive the actuator mechanism in the locked position.

According to a second aspect of the disclosure, a refuse vehicle, including a side loading arm, has a support rack coupled with the frame of the vehicle. The support rack comprises a frame to secure with the refuse vehicle. A support member is pivotally coupled with the frame. The support member receives the side loading arm. An actuating mechanism is coupled between the frame and the support member. The actuating mechanism moves the support member between a first and a second position. In the first position, the support member is in a locked position locking the side loading arm during over road traveling conditions. In the second position, the support member is in an unlocked position enabling the side loading arm to be moved away from the rack. The actuating member further comprises a cylinder and a linkage to move the support member between the first and second positions. A pin is positioned on the support member to engage a bore on the side loading arm to lock the side loading arm in position. A biasing bracket is coupled with the frame to receive the actuator mechanism in the locked position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
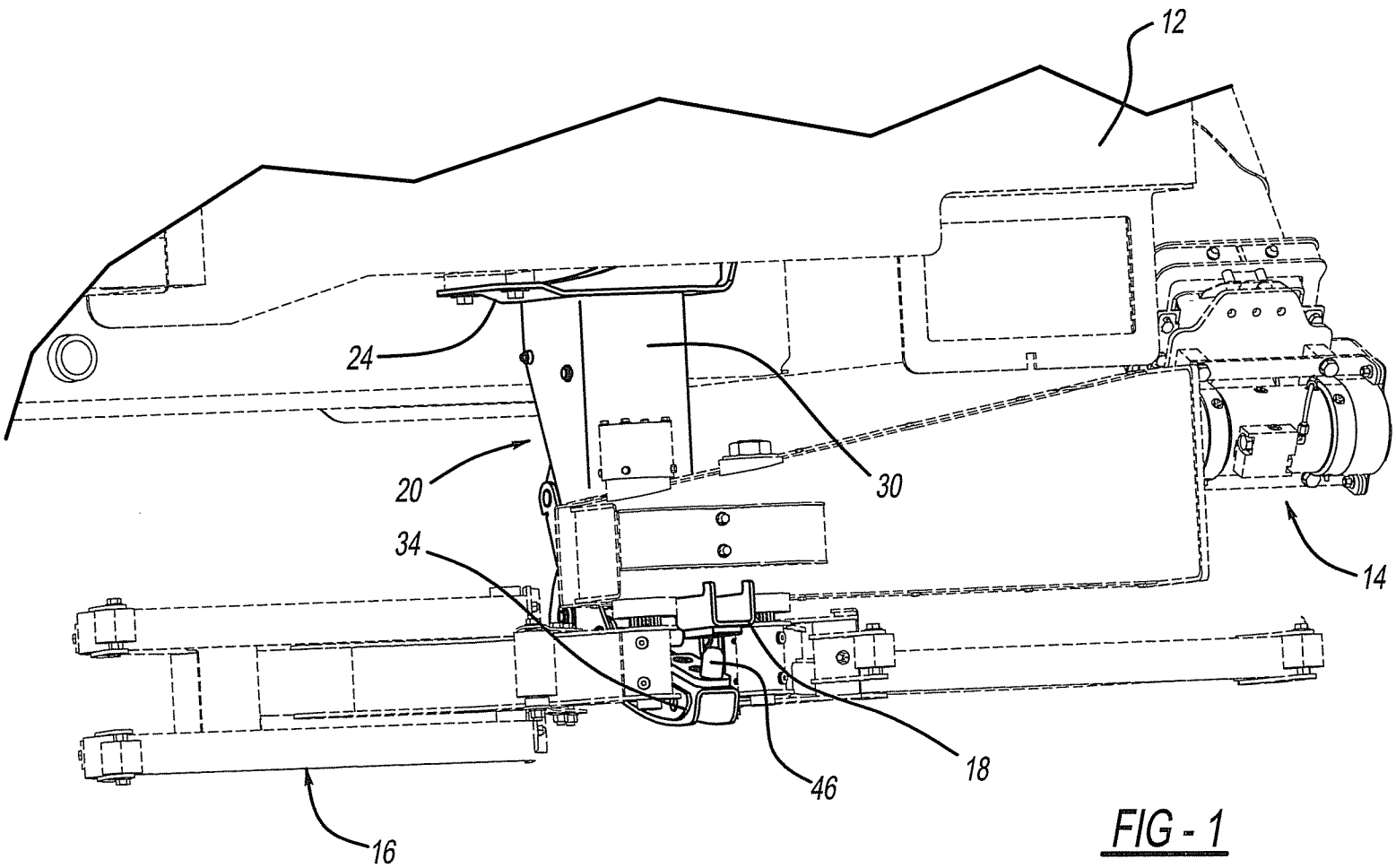
FIG. 1 is a perspective view of a storage rack of the present disclosure secured on a refuse vehicle.

Turning to the figures, a portion of a refuse vehicle is illustrated and designated with the reference numeral 10. The refuse vehicle 10 includes a collection container 12 and a side loading arm 14. The side loading arm 14 includes a grabber 16. The grabber 16 is supported on a support rack 20. The support rack 20 is coupled with the refuse vehicle 10. The side loading arm 14 includes a bracket 18 that receives a portion of the support rack 20 as will be discussed herein.

Figure 3:
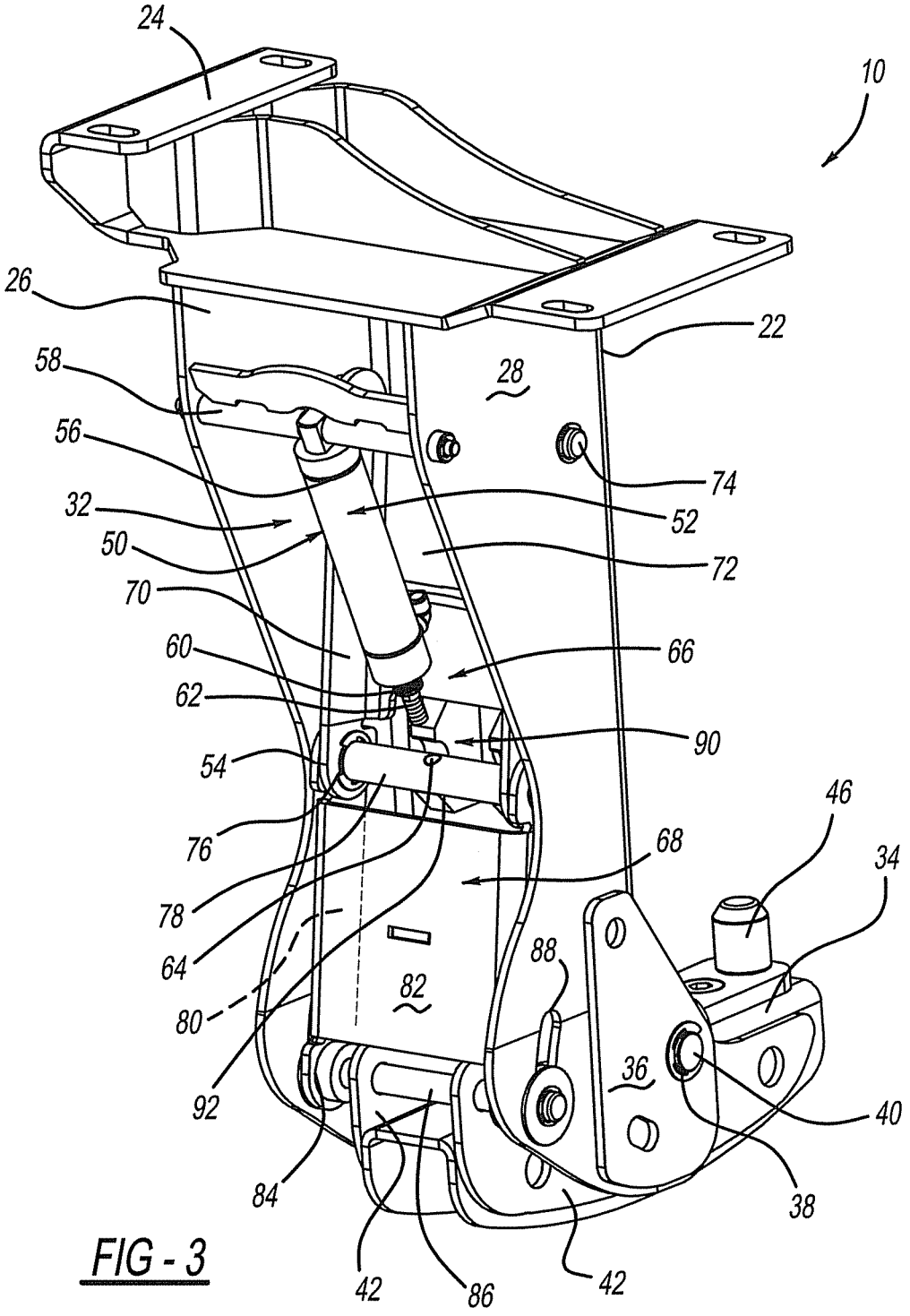
FIG. 3 is a rear perspective view of the support rack.
Figure 4:
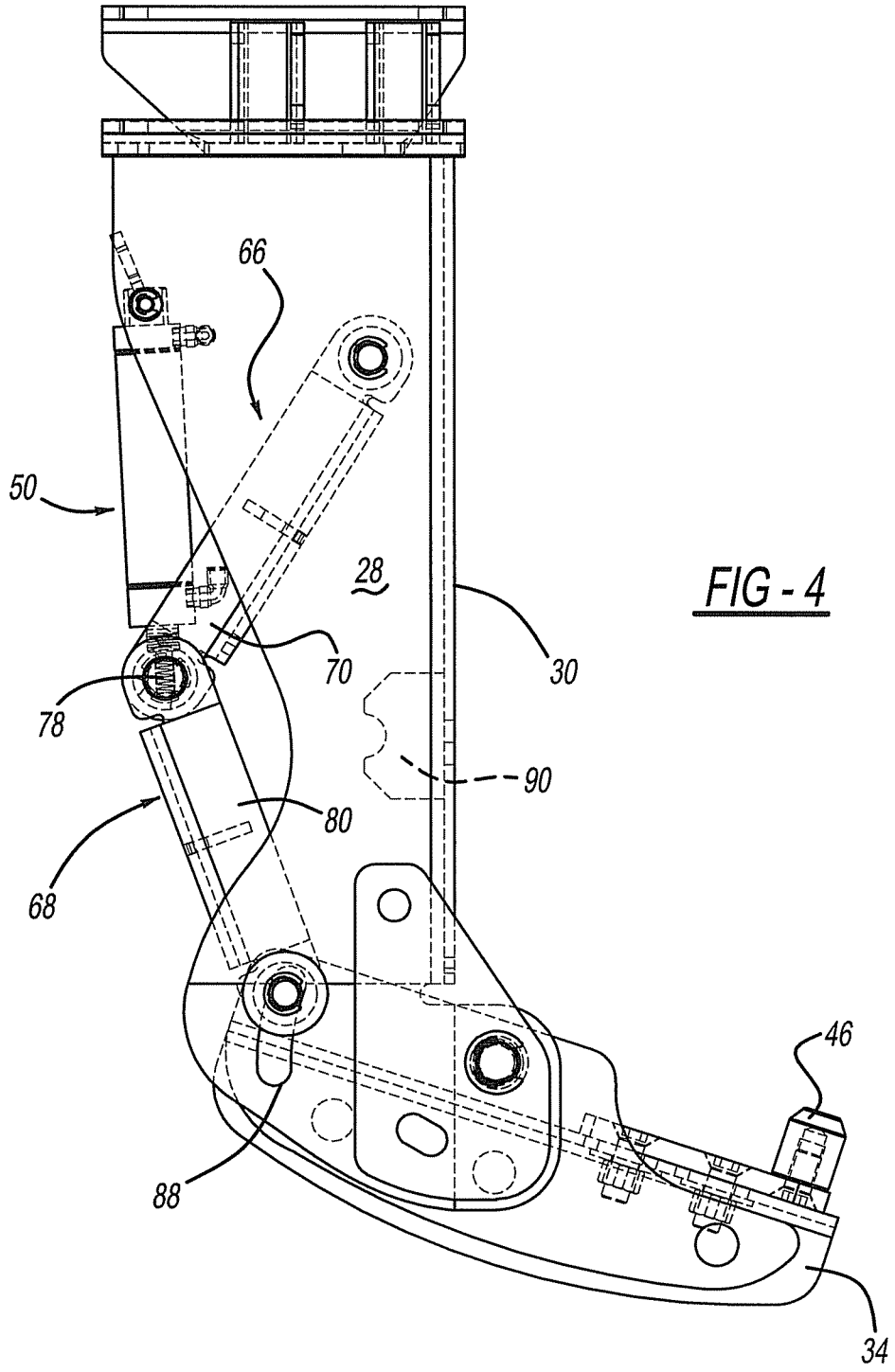
FIG. 4 is a side elevation view of the support rack of FIG. 3 in an unlocked condition.
Figure 5:
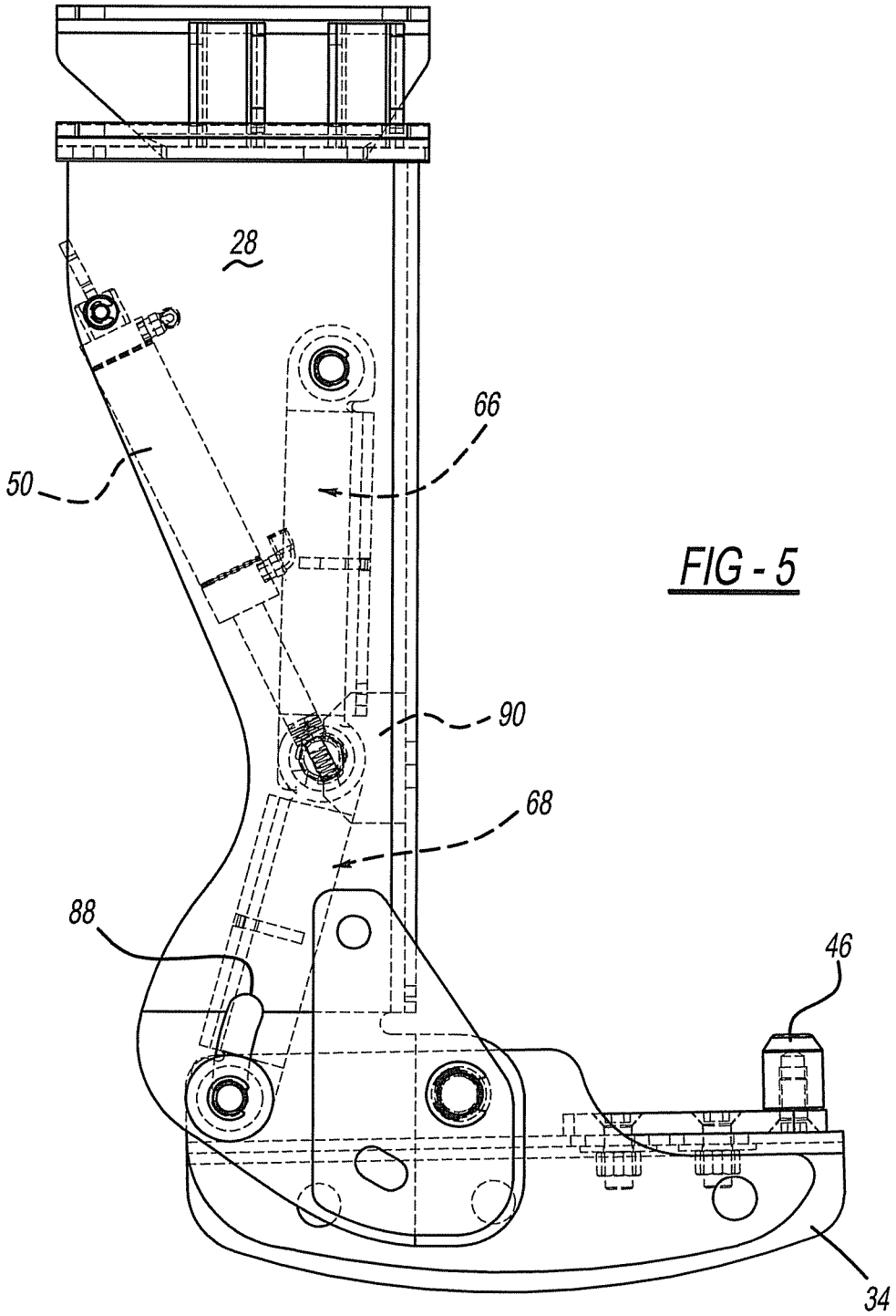
FIG. 5 is a view like FIG. 4 of the support rack in a locked condition.

Turning to FIG. 3-5, a better understanding of the support rack 20 may be had. The support rack 20 includes a frame 22 that includes an attachment member 24 to secure with the refuse vehicle. The frame 22 has an overall U-shape with a pair of sides 26, 28 connected by a web 30. The frame 22 thus forms a cavity 32 between the sides 26, 28 and web 30.

Figure 2:
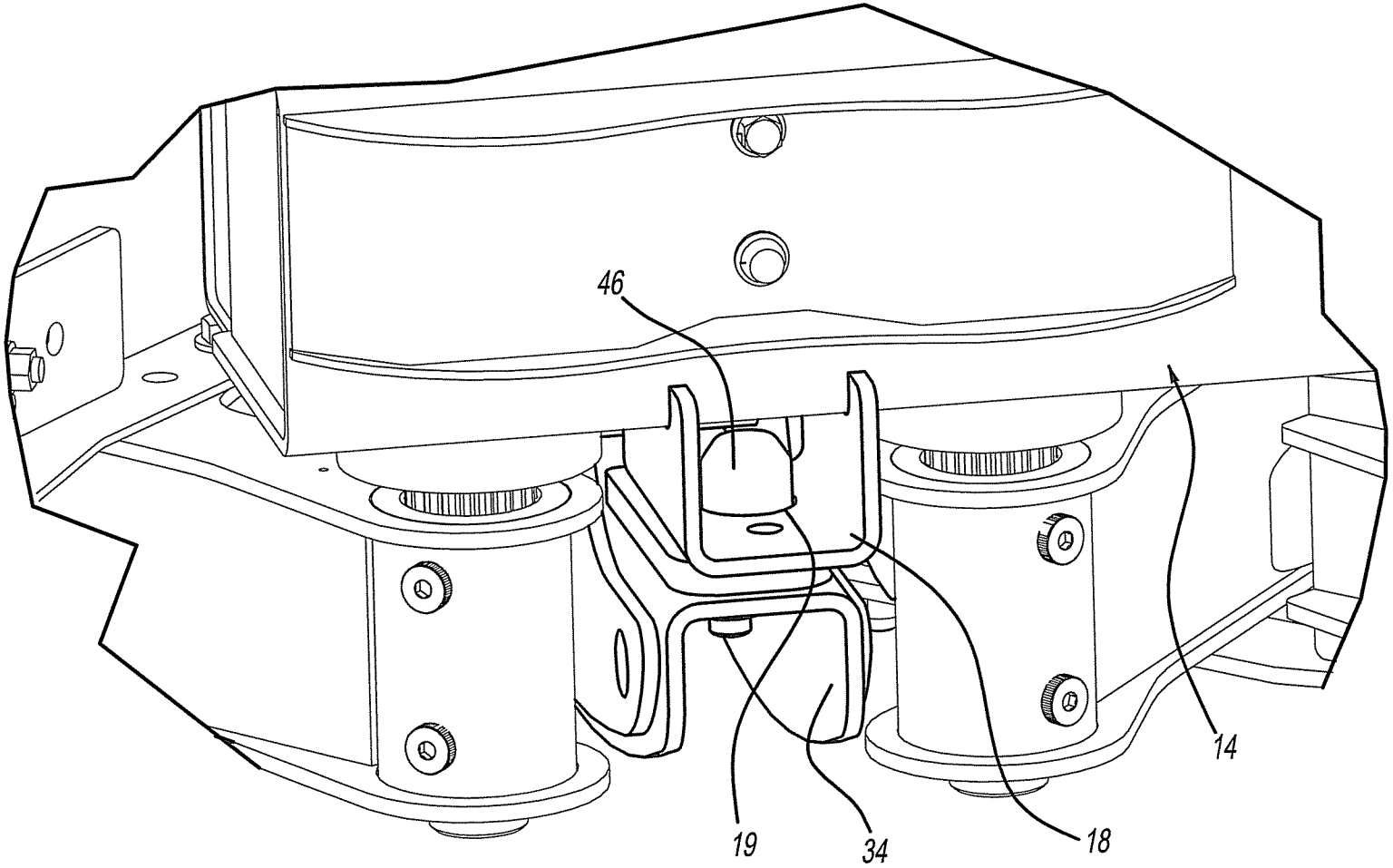
FIG. 2 is a perspective view of the support rack coupled with the side loading arm in a locked position.

A support member 34 is pivotally connected with the frame 22. A pair of plates 36 are welded or the like to the sides 26, 28 of the frame 22. The plates 36 include apertures 38 to receive a pin 40 that extends through the support member 34 to enable the support member 34 to pivot with respect to the frame 22. The support member 34 may have an overall U-shape to provide reinforcing strength for the support member 34. Additionally, plates 42 may be secured with the support member 34 to enhance the connection of the support member 34 with the frame 22 and actuator. The support member 34 includes a pin 46 that couples with the bracket 18 as seen in FIG. 2. The pin 46 projects through a bore 19 in the bracket 18 to lock the support rack 20 with the side loading arm 14.

An actuator 50 moves the support member 34 between its first locked position and its second unlocked position. The actuator 50 includes a cylinder 52 and a linkage 54. The cylinder 52 may be pneumatic, hydraulic or the like. The cylinder includes a housing 56 that is secured with a pin 58 which, in turn, is coupled with the frame sides 26, 28. The cylinder 52 has a piston rod 60 with a threaded end 62. The threaded end 62 is received in a threaded bore 64 of the linkage 54.

The linkage 54 includes a first link 66 and a second link 68. The link 66 includes side walls 70 and a web 72. The sidewalls 70 include apertures to receive a pin 74 to couple the link 66 with the frame 22. The sidewalls also include apertures 76 at the other end to receive a pin 78 which couples the links 66, 68 with one another. The pin 78 includes threaded bore 64. The link 68 includes sidewalls 80 and web 82. The sidewalls 80 include an aperture to receive the pin 78. Additionally, the sidewalls 80 include an aperture 84 to receive pin 86. Pin 86 is coupled with the support member 34, via plates 42, as well as the frame 22 through slots 88. The slots 88 enable the pin 86 to move within the slots 88 as the actuator is moved between positions which, in turn, moves the support member 34 between its locked and unlocked positions.

A dampening mechanism 90 is positioned on the frame 22 on the inside of web 30. The dampening mechanism 90 includes a pair of spring loaded locking brackets to receive the pin 78 when the actuator mechanism is in its locked over center position.

In use, when the support rack 20 is in an unlocked position, as illustrated in FIG. 4, the side loading arm 14 can be removed from the support bracket 20. The cylinder 52 is retracted and the links 66 and 68 are pulled away from the frame web 30. Here, the support member 34 is moved downward forming an obtuse angle with respect to the frame 22 as illustrated in FIG. 4. The pin 86 attached with link 68 is moved upward, toward attachment member 34, in the slot 88.

To lock the support rack 20 in position, the cylinder 52 is actuated. The piston rod 60 extends from the cylinder 50 moving the links 66, 68 toward the web 30 of the frame 22. As the support member 34 reaches its locked position, the pin 78 engages channels 92 in the dampening members 90 to hold the pin 78 with the links in their over center position. This locks the support member 34 in a position substantially perpendicular to the frame as illustrated in FIG. 5. Thus, with the pins 78 locked in the channels 92 of the dampening members, during over road traveling conditions, the dampening members 90 absorb the shock loads of the over road travel to provide dampening to the same.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A support rack for aside loading arm of a refuse vehicle comprising:

a frame separate from the side loading arm for fixedly securing with this refuse vehicle;

a support member pivotally coupled with the frame, the support member for receiving the side loading arms of the refuse vehicle;

an actuating mechanism coupled between the frame and the support member, the actuating mechanism moving the support member between a first and a second position wherein in the first position, the support member is in a locked position locking the side loading arm during over road traveling and in the second position, the support member is in an unlocked position enabling the side loading arm to be removed from the support rack.

2. The support rack of claim 1, wherein the actuator mechanism further comprises a cylinder and a link mechanism for moving the support mechanism between the first and second positions.

3. The support rack of claim 1, further comprising a pin on the support member for engaging a bore on the side loading arm.

4. The support rack of claim 1, wherein a dampening member is coupled with the frame for receiving the actuator mechanism in the locked position.

5. A refuse vehicle comprising:

a side loading arm;

a support rack fixedly coupled with the refuse vehicle;

the support rack comprising;

a frame for securing with the refuse vehicle;

a support member pivotally coupled with the frame, the support member for receiving the side loading arm;

an actuating mechanism coupled between the frame and the support member, the actuating mechanism moving the support member between a first and a second position wherein in the first position, the support member is in a locked position locking the side loading arm during over road traveling and in the second position, the support member is in an unlocked position enabling the side loading arm to be removed from the support rack.

6. The refuse vehicle of claim 5, wherein the actuator mechanism further comprises a cylinder and a link mechanism for moving the support mechanism between the first and second positions.

7. The refuse vehicle of claim 5, further comprising a pin on the support member for engaging a bore on the side loading arm.

8. The refuse vehicle of claim 5, wherein a dampening member is coupled with the frame for receiving the actuator mechanism in the locked position.

9. The refuse vehicle of claim 6, wherein the link mechanism includes a pair of link members.

10. The refuse vehicle of claim 8, wherein the dampening member includes a biasing bracket for receiving the actuator mechanism.

11. The refuse vehicle of claim 9, wherein a pin is coupled with one of the link members, the pin moving in a slot in the frame member for enabling movement of the support member between positions.

* * * * *